US006115887A

United States Patent [19]

Riter

[11] Patent Number: 6,115,887

[45] Date of Patent: Sep. 12, 2000

[54] LINEAR GIN SYSTEM AND METHOD

[75] Inventor: Edward Michael Riter, Selma, Ala.

[73] Assignee: Continental Eagle Corporation, Prattville, Ala.

[21] Appl. No.: 09/166,936

[22] Filed: Oct. 6, 1998

[51] Int. Cl.[7] ..... D01B 1/04

[52] U.S. Cl. ..... 19/48 R; 19/39; 19/53

[58] Field of Search ..... 19/39, 40, 41, 19/42, 48 R, 49, 50, 51, 53, 64.5, 145.5; 198/844.2, 847

[56] References Cited

U.S. PATENT DOCUMENTS

| | | | |
|---|---|---|---|
| 619,116 | 2/1899 | Barber . | |
| 906,168 | 12/1908 | Shumaker . | |
| 927,586 | 7/1909 | O'Brien | 19/41 |
| 1,192,660 | 7/1916 | Marsden | 19/48 R |
| 3,484,904 | 12/1969 | Berriman et al. . | |
| 4,094,043 | 6/1978 | Vandergriff . | |
| 4,109,543 | 8/1978 | Foti | 198/847 |
| 4,813,533 | 3/1989 | Long | 198/847 |

FOREIGN PATENT DOCUMENTS

| | | | |
|---|---|---|---|
| 243138 | 9/1969 | U.S.S.R. | 19/48 R |
| 11345 | 4/1890 | United Kingdom . | |
| 310847 | 4/1929 | United Kingdom . | |
| 1042230 | 9/1966 | United Kingdom . | |
| WO/97/45572 | 12/1997 | WIPO . | |

*Primary Examiner*—John J. Calvert
*Assistant Examiner*—Gary L. Welch
*Attorney, Agent, or Firm*—Jacobson, Price, Holman & Stern, PLLC

[57] ABSTRACT

A linear belt flight has an upper high friction surface to which seed cotton adheres for conveyance to a transverse fixedly positioned knife adjacently above the belt flight; the cotton fibers move beneath the knife to separate the fibers from the seed which move onto the upper surface of the knife. A rotary knife engages the separated seed on the upper surface of the fixedly positioned knife and propels the seed rearwardly onto an auger conveyor for removal of the seed while air doffing means removes the fiber from the upper surface of the linear belt flight downstream of the knife.

9 Claims, 7 Drawing Sheets

LINEAR GIN SYSTEM AND METHOD

BACKGROUND OF THE INVENTION

1. Field of the Invention

The present invention relates to cotton gin apparatus and a methods of ginning. More specifically, the invention relates to a linear gin and method in which seed cotton is moved in a linear direction on a moving belt past a stationary knife blade which creates a pinch point between the belt and knife blade by which the lint is pinched off the seed. The removed lint is then conveyed off the belt with suction air. Thus, the belt and knife do the ginning, the suction air plays no part in the ginning (lint from seed separation) but only serves to convey lint after the separation has occurred.

2. Related Art

The history of cotton ginning is replete with a wide variety of devices proposed for separating the cotton fiber from the seed. Many of the prior art devices were provided in an effort to meet the special characteristics of various types of cotton such as upland cotton and long staple or sea island cotton.

The two main types of gins that have been employed are the saw gin which has been primarily used for separating the fuzzy seed from upland cotton and the roller gin which has been primarily used for separating the long staple or black seed cotton seed from the longer fiber such as sea island or Egyptian cotton. The saw gin has not been acceptable for ginning longer staple cotton because of the fact that it breaks and tangles the fiber so as to result in a shorter staple product which is generally less valuable than the longer staple fiber. Thus, it has evolved that almost all of the long staple cotton has been ginned with roller gins whereas the upland cotton has been ginned with saw gins.

Many of the earlier roller gins employed a stationary doctor knife and a cooperating reciprocating blade to strip the seeds from the fibers as the fibers were moved past the doctor knife by the ginning roller. A particular disadvantage of the foregoing construction was that the fibers were produced in a somewhat intermittent manner due to the reciprocating operation of the blade which would interrupt flow of cotton to the ginning roller and consequently reduce the production rate of the gin.

Many efforts have been made to improve the roller gin with respect to the rate of fiber production so as to reduce the cost of ginning black seed cotton while retaining the advantageous characteristics of the roller gin in producing fibers that are not entangled or broken. The foregoing efforts led to the construction of roller gins having a ginning roller turning adjacent a stationary knife so that the fibers are drawn under the knife while the seeds are retained by the knife to effect separation of the fibers from the seed. Unfortunately, many of the prior art devices employing the foregoing technique were not successful due to a considerable amount of seed cracking that resulted from their operation.

Vandergriff U.S. Pat. No. 4,094,043 is an example of a roller gin employing a ginning roller 36 having a friction surface of cover 38 made of leather or rubber-like material to which cotton fibers adhere for conveyance into contact with a stationary ginning knife 40. A square rotobar blade assembly 42 is rotated upstream of the knife assembly as shown in FIG. 6A of the patent. The construction of the Vandergriff patent is complex and, while representing an improvement over many of the prior known ginning devices, was expensive to construct and maintain and did not provide a full or complete solution to the prior known shortcomings of roller gins.

Barber U.S. Pat. No. 619,116 discloses a cotton gin employing a moveable belt 14 having a series of rigid plates 15 attached to its outer periphery for gripping and conveying cotton passed a stationary blade 28. A plurality of rapidly moving pivotally mounted fingers 26 and 27 separate the seed from the cotton. A blower removes the cotton from the belt in the area of rollers 12 or 13. This complicated construction has not achieved any substantial acceptance in the industry.

Berrman et al. U.S. Pat. No. 3,484,904 discloses a complicated gin employing a high speed rotor 12, brushes 14F and a handling system by means of which the cotton fibers are separated from the seed.

Therefore, it is the primary object of the subject invention to provide a new and improved gin.

A further object of the subject invention is the provision of a new and improved gin of simple, reliable and economical construction.

SUMMARY OF THE INVENTION

The present invention achieves the foregoing objects by the employment of a flat belt having a horizontal upper flight providing a high friction surface on which seed cotton is deposited by in feed equipment. The belt is formed of a plurality of fabric panel components bonded together so that the individual fabric panel components are oriented in a vertical plane and the upper surface of the upper flight of the belt is formed of the edges of the individual fabric panel components. The belt is supported upon upstream and a downstream rollers one of which is power driven so that the cotton on the upper flight of the belt is carried into contact with a conventional horizontally extending knife positioned transversely across the upper surface of the upper flight of the belt. A suction type doffing chamber is provided adjacent the lower/downstream side of the knife to remove the lint after separation. The lint adheres to the upper surface of the belt so that it is pulled through the space between the lower surface of the knife and the upper surface of the belt while leaving the seed on the upper surface of the knife.

A rotating rotary knife is positioned immediately adjacent and above the upper surface of the knife and has radial blades which are rotated at a fairly high rate of speed to engage the seed remaining on the upper surface of the knife and to hurl the seed rearwardly into an auger conveyor system which is driven to deliver the seed to one side of the belt. Meanwhile, a vacuum removal system carries the lint from the downstream side of the knife for delivery to conventional downstream fiber handling means. In a second embodiment, the knife and backup support means are canted at an acute angle relative to the direction of movement of the upper flight so that more knife length can be provided for effecting the separation of the seed from the cotton fiber.

In a third embodiment, identical ginning assemblies are provided both on the upper belt flight and within the interior of the belt loop above the lower flight. Each flight receives cotton fiber on its upper surface and conveys it to one of the plurality of gin assemblies. Each gin assembly operates in the same manner as the gin assembly of the first embodiment for separating the seed from the lint and for removing both the seed and the lint from the gin assembly.

Other objects, features and advantages of the present invention will be apparent to those skilled in the art upon a reading of this specification and considering the accompanying drawings.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
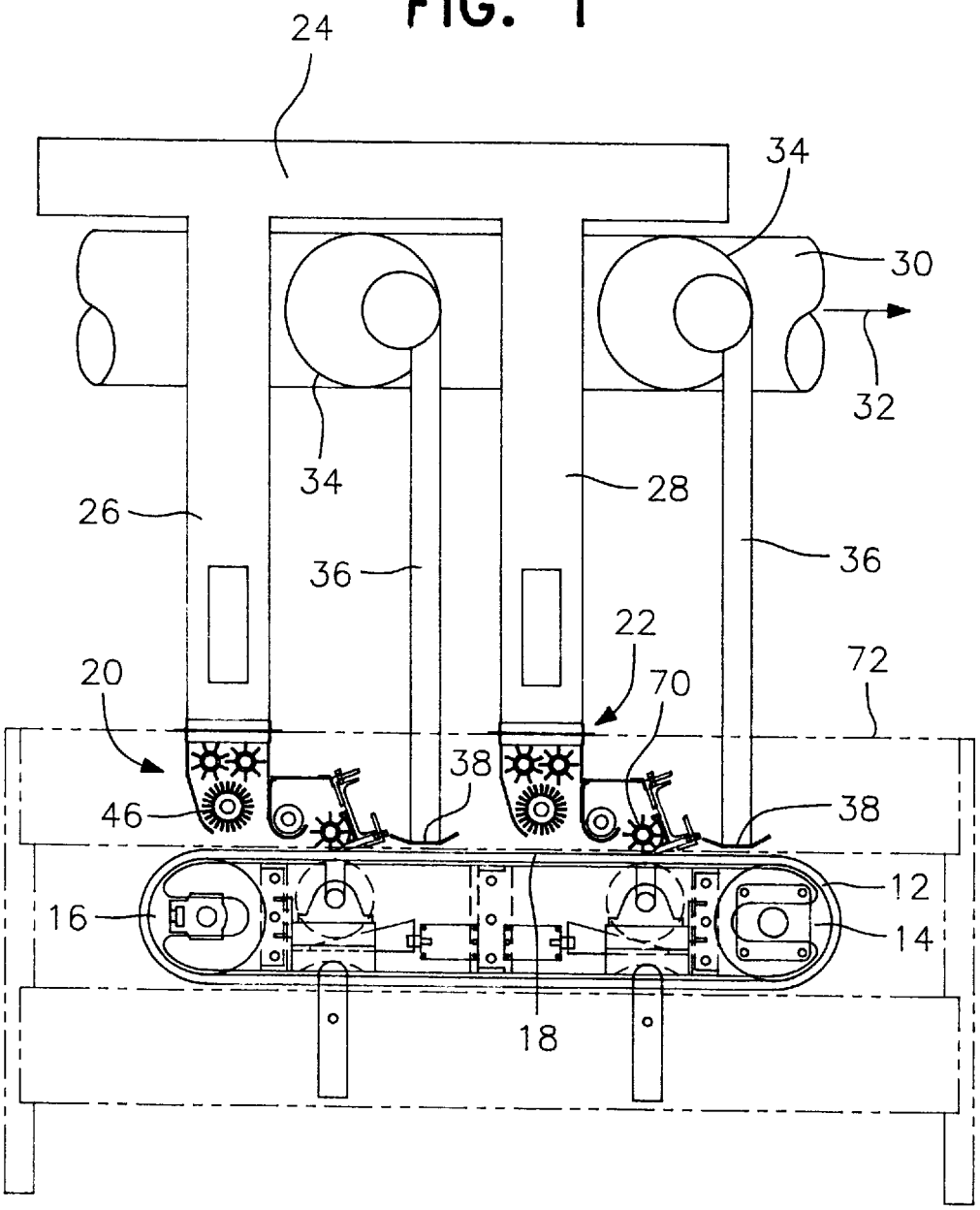
FIG. 1 is a front elevation view of a first embodiment of the invention.
Figure 2:
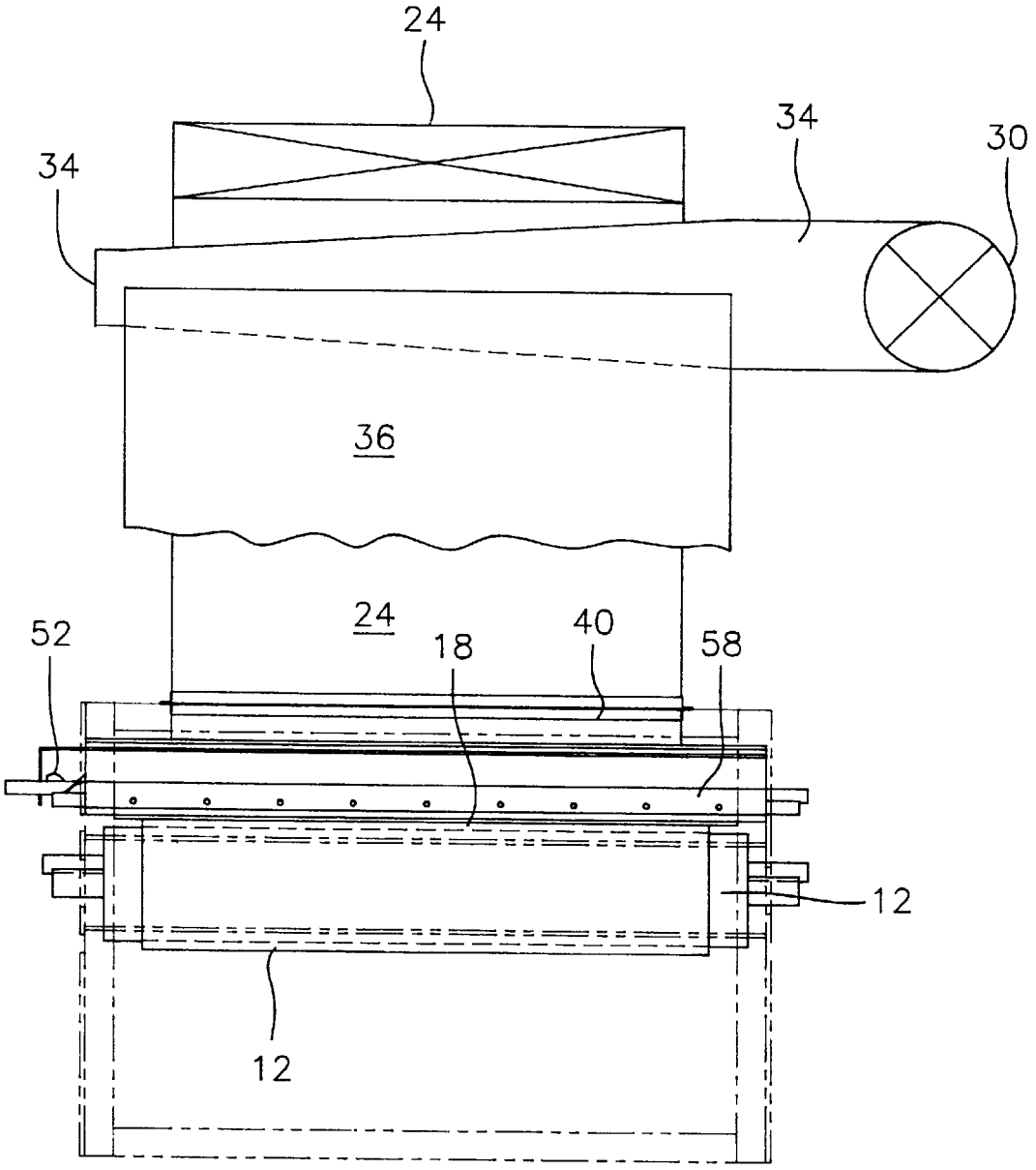
FIG. 2 is an end elevation view of the embodiment of FIG. 1.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

Figure 3:
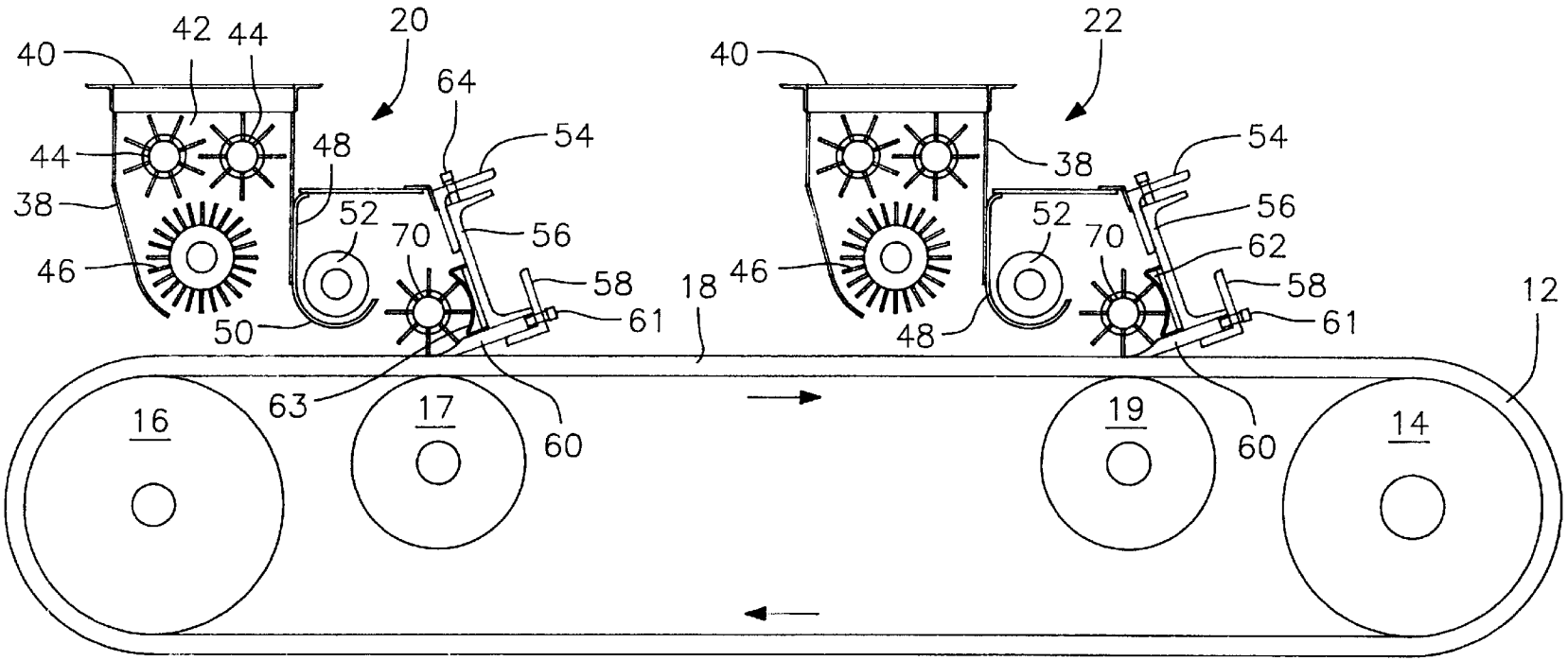
FIG. 3 is an enlarged view of the ginning assembly portion of FIG. 1.
Figure 4:
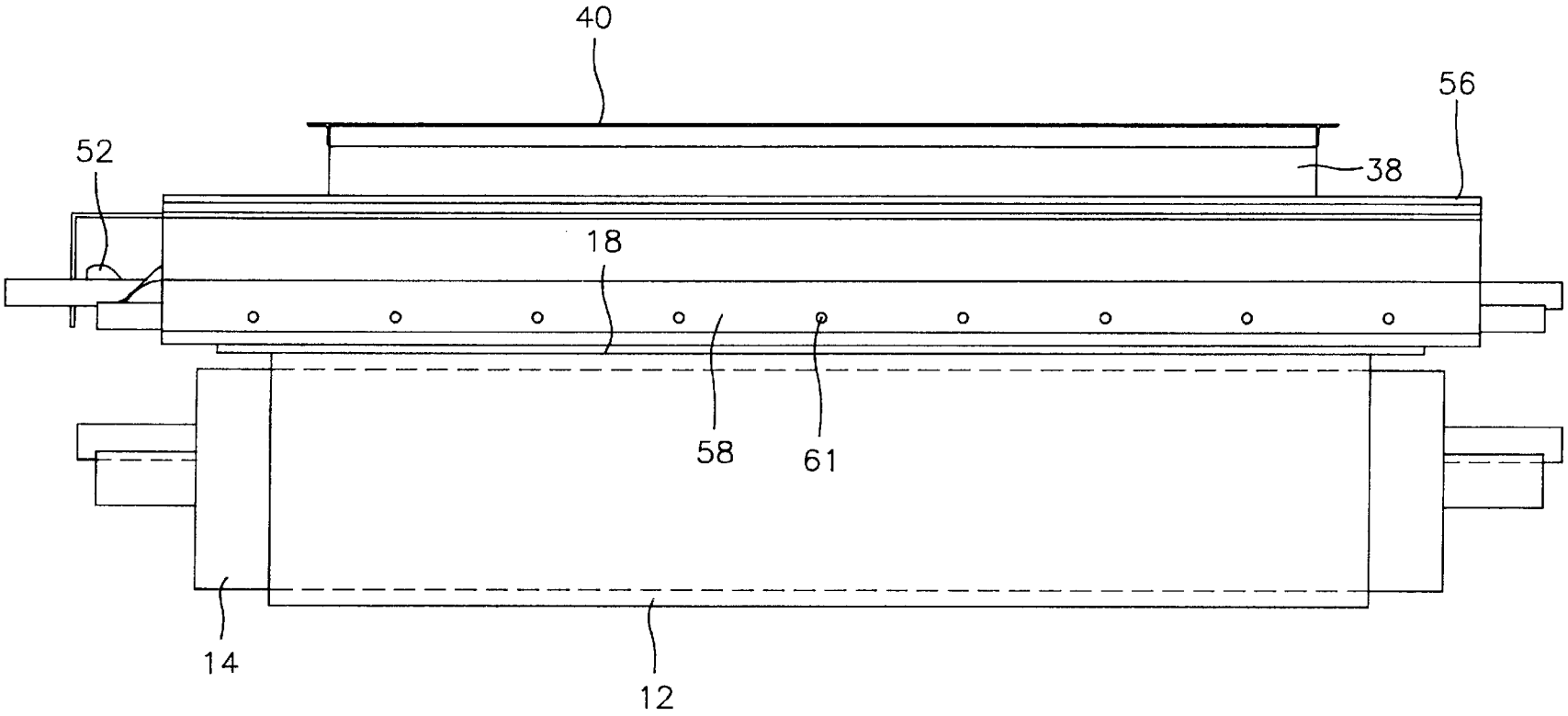
FIG. 4 is an end view of the assembly of FIG. 3.
Figure 5:
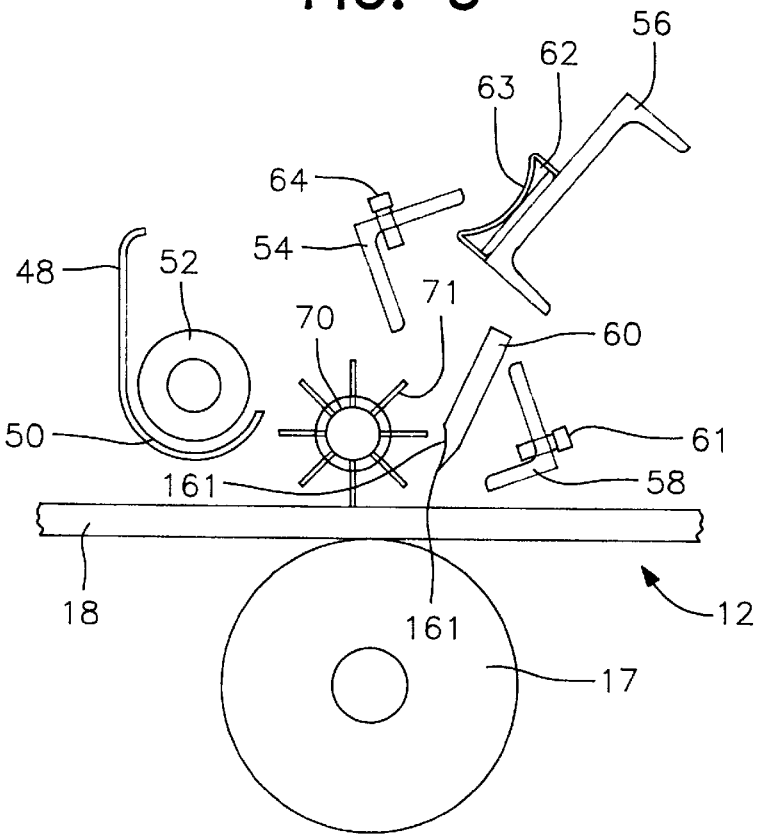
FIG. 5 is an exploded view of the components of the ginning assembly of FIG. 3.
Figure 6:
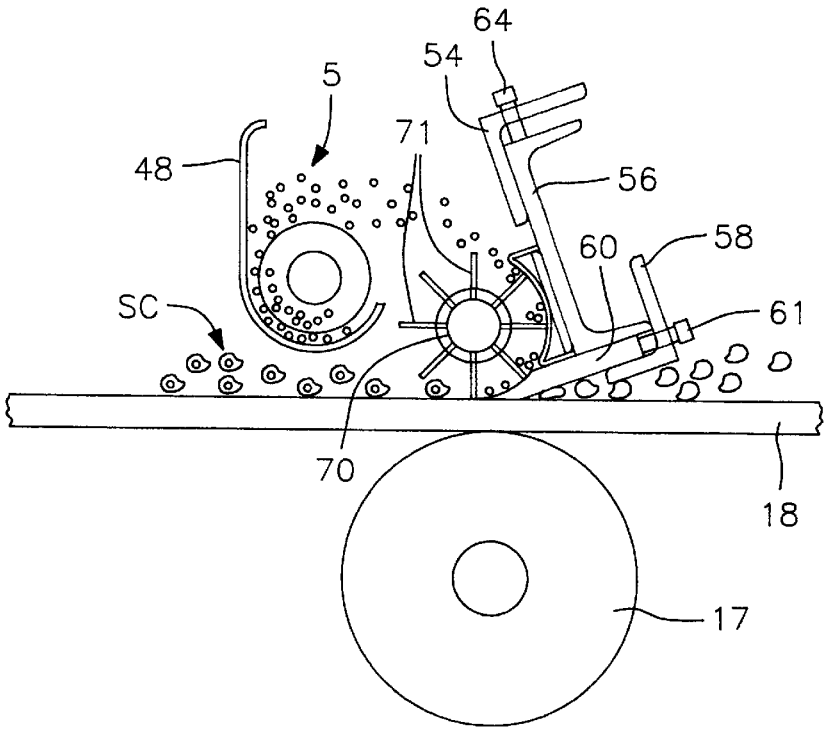
FIG. 6 is a view of the components of FIG. 5 in assembled condition showing the seed cotton, seed and the ginned cotton being handled by the assembly.
Figure 7:
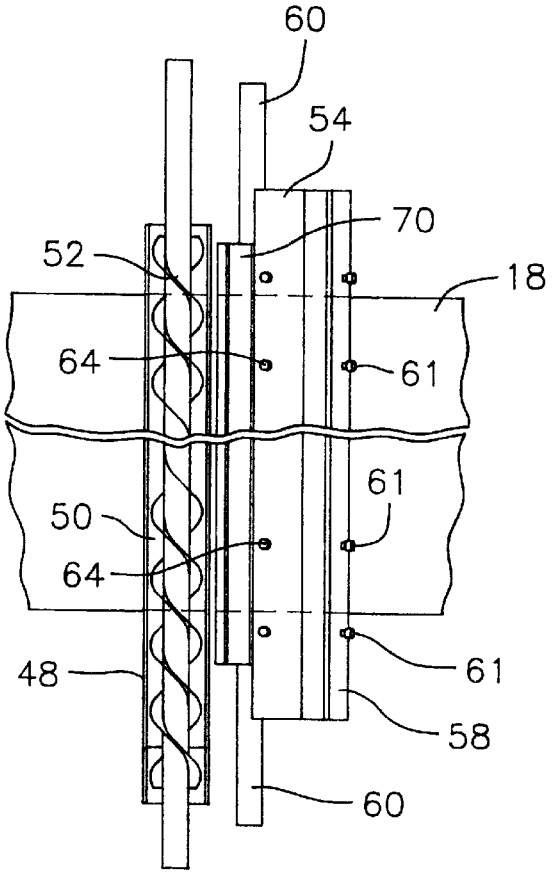
FIG. 7 is a top plan view of the ginning assembly.

A first embodiment of the invention is shown in FIGS. 1–8 and comprises a driven flexible belt 12 supported by a drive roller 14 and a idler roller 16 so that the upper flight 18 of the belt 12 moves from left to right as shown in FIG. 1. An upstream gin assembly or works 20 and a downstream gin assembly 22 are mounted adjacently above the upper flight 18 of belt 12 for receiving and ginning seed cotton provided on the upper surface of flight 18. The upstream gin assembly 20 and the downstream gin assembly 22 are identical to each other. It should also be noted that upstream and downstream idler pressure rollers 17 and 19 engage and support the upper flight 18 as best shown in FIG. 3.

Seed cotton is provided to the upstream and downstream gin assemblies 20 and 22 by a feed works main seed duct 24 downward from which vertically extending seed cotton supply chutes 26 and 28 respectively extend for connection to the infeed portion of gin assemblies 20 and 22 respectively.

Doffing works include a lint removal or out feed lint duct 30 extending parallel to the upper flight 18 of belt 12 and which is connected at its downstream end to a vacuum source (not shown) which moves air in duct 30 in the direction of arrow 32. The outfeed lint duct 30 is connected to two transversely extending tapered suction plenums 34 each of which has a lint gathering vertically extending duct 36 extending downwardly with an open lower end 38 communicating with the downstream side of one of the gin assemblies 20 or 22. The purpose of the lint gathering vertically extending ducts 36 is to remove the ginned lint from the gin assembly with which the duct assembly is associated.

The structural details of gin assemblies or works 20 and 22 will be better understood with reference to FIGS. 3–7 in connection with the following discussion.

Each gin assembly comprises a seed cotton supply housing 38 having an upper flanged end 40 connected to the lower ends of one or the other of the seed cotton supply chutes 26 or 28 for receiving seed cotton to be ginned. Seed cotton supply housing 38 defines an inner chamber 42 in which a pair of seed rollers 44 extend transversely above and with respect to the upper flight 18 of the belt. A large feed wheel 46 is provided below the small feed rollers 44 at the lower end in feed chamber 42 for directing the seed cotton onto the upper surface of the upper flight 18 of belt 12.

A transverse auger housing 48 having a curved channel 50 at its lower end extends transversely above upper flight 18 and is shaped to receive a power driven seed removal auger 52 as shown in FIG. 3. A transverse angle beam 54 extends transversely across upper flight 18 and provides support for a stiffener/clamp 56 which in turn supports a knife retainer 58. A knife member 60 is held in position so that its lower surface engages the upper surface of flight 18 by knife retainer 58 as shown in FIG. 3. Knife 60 has a curved cylindrical forward surface 161 having a radius of curvature of approximately two inches and can 10 be adjusted forwardly by a plurality of adjustment screws 61 threadably received in the knife retainer 58. Knife 60 can, for example, be of the type illustrated on page 248 of Cotton Ginners Handbook published December 1994 by the United States Department of Agriculture. Additionally, it should be noted that adjustment screws 64 threadably mounted in transverse angle beam 54 permit fine adjustment of the deflection of the knife.

A feed guide block having a cylindrical surface 63 is fixedly positioned to the forward lower surface of the stiffener/clamp 56. A seed removal rotary knife 70 having radial blades 71 mounted immediately upstream of the cylindrical surface 63 and is driven to rotate in a counter clockwise direction as viewed in FIG. 6. Blades 71 can be formed of metal or other materials such as rubber or plastic. The upper flight of belt 12 and the upstream and downstream gin assemblies 20 and 22 is enclosed in a housing 72 as shown in FIG. 1.

In operation, the main seed cotton seed feed duct 24 provides seed cotton to the upper ends of the downwardly extending feed cotton supply chutes 26 which in turn deliver the seed cotton into in feed chamber 42 of each gin assembly. The small feed rollers 44 rotate in opposite directions and deliver the seed cotton SC (FIG. 6) into the large feed wheel 46 which rotates so as to deliver the seed cotton onto the upper surface of the upper flight 18 in an obvious manner. Movement of the upper flight carries the seed cotton into contact with the lower surface of knife member 60. The cotton lint adheres to the upper surface of flight 18 which is roughened so that the lint is pulled through the space between the bottom of knife 60 and the upper surface of flight 18 to effect separation of the seed from the lint. The seed remains on the upper surface of the knife and are engaged by counter clockwise rotating seed removal rotary knife 70. Rotary knife 70 is rotating in a counter-clockwise direction and carries the seed at sufficiently high velocity to cause the seeds to be propelled into transverse auger housing 48 and fall into the curved channel 50 so that the rotating auger 52 conveys the seed transversely to the side of the belt for removal from the gin assembly. The lint is gathered by suction in the vertically extending duct 36 and is conveyed into the lint removal and out feed duct 30 which conveys it to downstream processing equipment.

Figure 9:
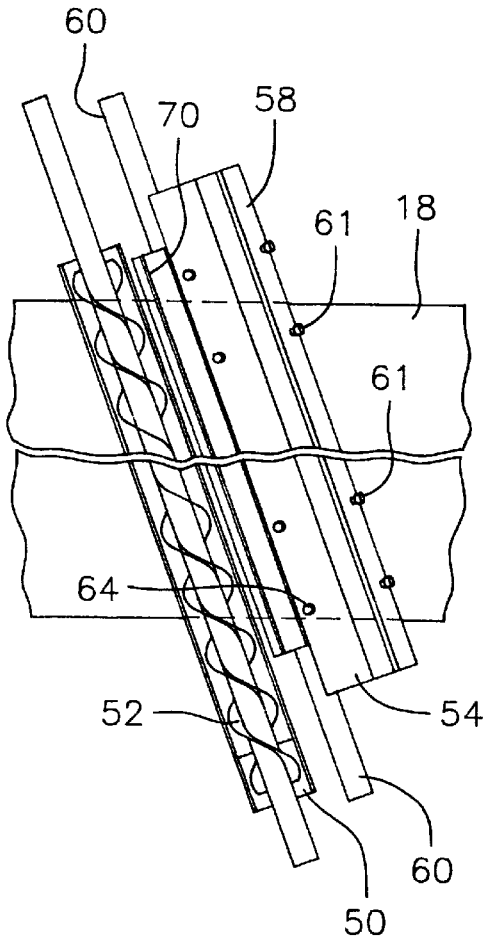
FIG. 9 is a top plan view of a second embodiment.
Figure 8:
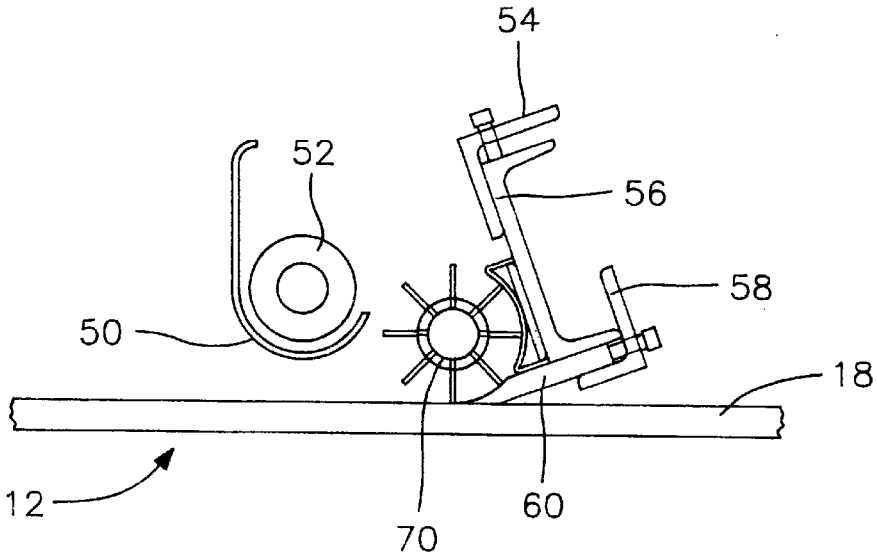
FIG. 8 is an end view of the assembly of FIG. 7.

FIG. 9 illustrates a second embodiment of the invention in which a gin assemblies is canted at an angle relative to the direction of movement of the upper flight 18. It is consequently possible to obtain increased production since there is a longer length of knife across the width of the upper flight of the belt. However, if the arrangement of the type illustrated in FIG. 9 is used, it is necessary that the backup pressure rollers also be canted to remain in alignment with the blade and the rollers must be provided with a low friction coating such as Teflon since there will be some relative movement with respect to the outer surface of the rollers and the lower surface of the upper flight of the belt. An optional arrangement would be to employ a plurality of spherical bearings aligned with and beneath knife 60 to backup the gin belt. An additional option would be to provide a series of small roller bearings each having an axis of rotation perpendicular to the direction of movement of the upper flight but being with each roller being mounted either upstream or downstream with respect to the next adjacent roller.

Figure 10:
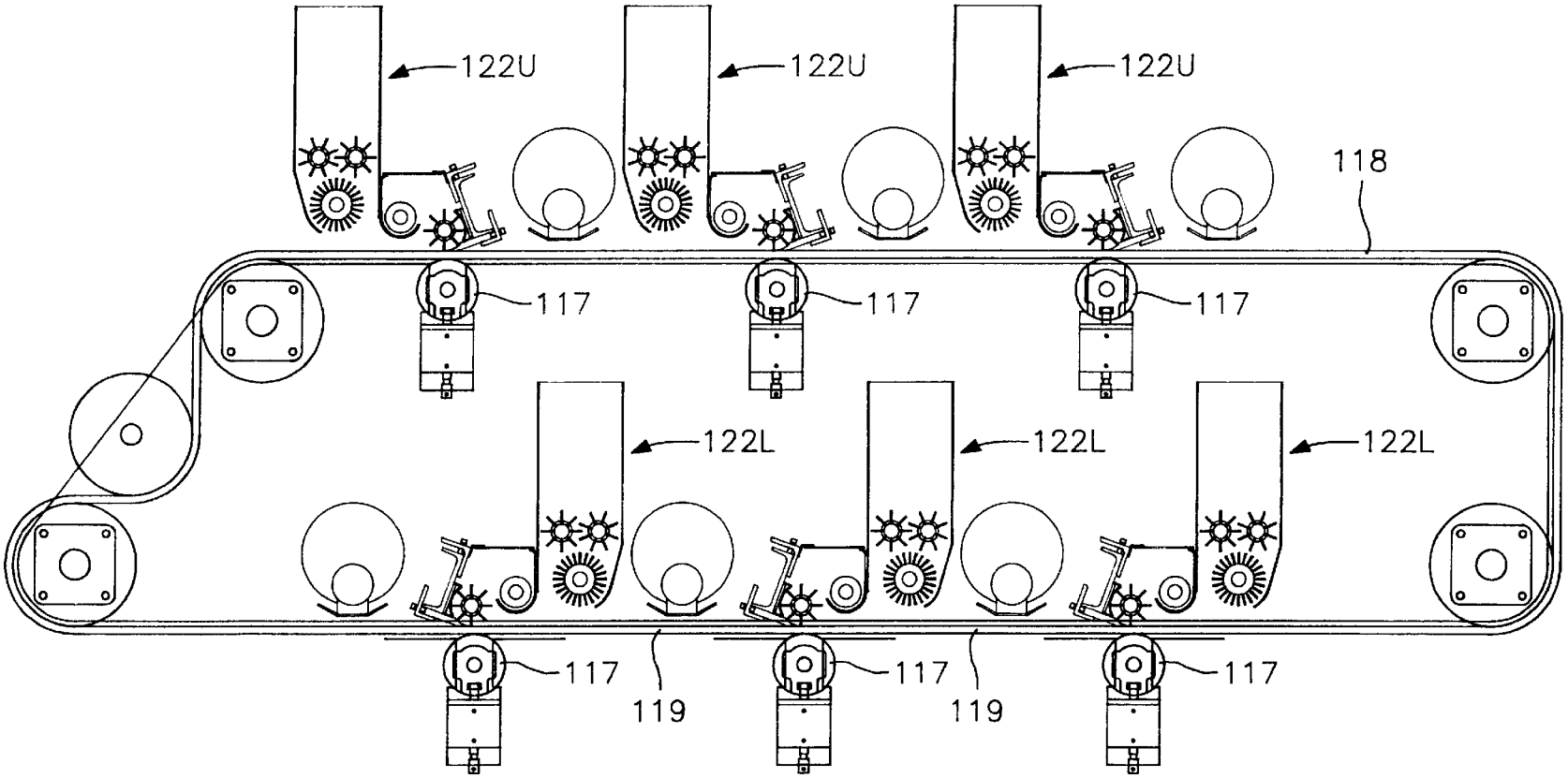
FIG. 10 is a front elevation view of a third embodiment shown partially in section for clarity.

FIG. 10 illustrates a third embodiment in which three identical gin assemblies 122U that are all identical to gin assemblies 20 and 22 are provided above the upper flight 118 of an enlarged conveyor belt and three lower gin assemblies 122L are provided immediately above the inner surface of the lower flight 119 of the conveyor belt. Backup pressure rollers 117 are positioned below the belt areas contacted by the respective knife members of each of the gin assemblies as shown in FIG. 10. Each gin assembly would receive seed cotton, separate the seed from the lint and deliver the lint to a lint gathering vertically extending duct in essentially the same manner as the gin assemblies 20 and 22 of the first embodiment. However, the seed feed and lint removal means etc. is not shown in FIG. 10 for the sake of clarity.

The belt 12 is preferably constructed of material sold by Garlock, Inc. of Palmyra, N.Y. under the trademark GARLOCK®. The aforementioned Garlock, Inc. material is normally used for covering rollers employed in roller gins and is formed of a laminate construction consisting of 15 or more layers of woven or knitted fabric sheets or panels bonded together by a polymer. The sheets or panels of the material are oriented in a vertical plane perpendicular to the upper surface of the upper flight 18 of the belt as employed in the invention. The aforementioned orientation is the same orientation of the material as used in the rollers of roller gins. It has been found that by using GARLOCK® material with the upper belt surface being the edges of the sheets or panels or fabric components that there is an increased adhesion of the cotton lint to the fabric so that it is forcefully conveyed into contact with the fixed knife means 70 to separate the seed from the lint. However, it should be understood that belt 12 can be formed of other material such as cotton nitrile or other rubber or woven metal or combinations of different materials.

Additional modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A linear gin for separating cotton seed from fiber comprising a driven belt having a linear belt flight extending for linear movement in a forward direction of movement between supporting roller means and having first and second edge portions, a first surface for receiving and transporting seed cotton and a second surface on an opposite side from the first surface, said first surface being roughened so that cotton fiber will adhere to it, an air doffing chamber extending transversely across said linear belt flight adjacent said first surface, a fixedly positioned knife upstream of said air doffing chamber extending transversely across said linear belt flight and having a lower surface in contact with said linear belt flight to define a pinch point between said knife lower surface and the first surface of said linear belt flight so that adhesion of the cotton fiber to the first surface of the linear belt flight pulls the fiber through the pinch point while simultaneously separating the fiber from the seed which move onto an upper surface of the knife while the fiber moves into the air doffing chamber and additionally including a linear belt flight backup means engaging said second surface of said linear belt flight in a position in substantial alignment with said fixedly positioned knife and powered conveyor means comprising a driven seed removing auger positioned in a curved channel extending across the width of said linear belt flight for conveying the separated seed transversely relative to said linear belt flight to a discharge position.

2. A linear gin for separating cotton seed from fiber comprising a driven belt having a linear belt flight extending for linear movement in a forward direction of movement between supporting roller means and having first and second edge portions, a first surface for receiving and transporting seed cotton and a second surface on an opposite side from the first surface, said first surface being roughened so that cotton fiber will adhere to it, an air doffing chamber extending transversely across said linear belt flight adjacent said first surface, a fixedly positioned knife upstream of said air doffing chamber extending transversely across said linear belt flight and having a lower surface in contact with said linear belt flight to define a pinch point between said knife lower surface and the first surface of said linear belt flight so that adhesion of the cotton fiber to the first surface of the linear belt flight pulls the fiber through the pinch point while simultaneously separating the fiber from the seed which move onto an upper surface of the knife while the fiber moves into the air doffing chamber, powered conveyor means conveying the separated seed transversely relative to said linear belt flight to a discharge position and including power driven rotary knife means positioned above said fixedly positioned knife means for engaging separated seed and propelling said seed onto said powered conveyor means.

3. The linear gin of claim 2, wherein said powered conveyor means comprises a driven seed removing auger positioned in a curved channel extend across the width of said linear belt flight.

4. A linear gin for separating cotton seed from fiber comprising a driven belt having a linear belt flight having a substantially horizontal component of orientation extending for linear movement in a forward direction of movement between supporting roller means and having first and second edge portions, a first surface for receiving and transporting seed cotton and a second surface on an opposite side from the first surface, said first surface being roughened so that cotton fiber will adhere to it, an air doffing chamber extending transversely across said linear belt flight adjacent said first surface, a fixedly positioned knife upstream of said air doffing chamber having a substantially transverse component of orientation relative to said linear belt flight extending transversely across said linear belt flight and having a lower surface in contact with said linear belt flight to define a pinch point between said knife lower surface and the first surface of said linear belt flight so that adhesion of the cotton fiber to the first surface of the linear belt flight pulls the fiber through the pinch point while simultaneously separating the fiber from the seed which move onto an upper surface of the knife while the fiber moves into the air doffing chamber and additionally including a linear belt flight backup means comprising roller means adjacent said second surface of said linear belt flight in substantial alignment with said fixedly positioned knife and powered conveyor means comprising a driven seed removing auger positioned in a curved channel extending across the width of said linear belt flight.

5. The linear gin of claim 4, additionally including power driven rotary knife means positioned above said fixedly positioned knife means for engaging separated seed and propelling said seed onto said power driven conveyor means.

6. A linear gin for separating cotton seed from fiber comprising a driven belt having a linear belt flight comprising an upper belt flight which is positioned at a higher elevation than other belt portions extending for linear movement in a forward direction of movement between supporting roller means and having first and second edge portions, a first surface for receiving and transporting seed cotton and a second surface on an opposite side from the first surface, said first surface being roughened so that cotton fiber will adhere to it, an air doffing chamber extending transversely across said linear belt flight adjacent said first surface, a fixedly positioned knife upstream of said air doffing chamber extending transversely across said linear belt flight and having a lower surface in contact with said linear belt flight to define a pinch point between said knife lower surface and the upper surface of said linear belt flight so that adhesion of the cotton fiber to the upper surface of the linear belt flight pulls the fiber through the pinch point while simultaneously separating the fiber from the seed which move onto an upper surface of the knife while the fiber moves into the air doffing chamber and wherein said driven belt includes a second linear belt flight, and further including a plurality of gin assembly means provided adjacent said second linear belt flight for receiving seed cotton from an upper surface of said second linear belt fight and separating the seed from the fiber of said last mentioned seed cotton.

7. A linear gin as recited in claim 6, wherein said second linear belt flight is in vertical alignment with said first linear belt flight.

8. The linear gin as recited in claim 7, wherein said linear belt flights both have a substantial horizontal component of orientation.

9. A linear gin comprising a seed cotton support having an upper surface to which cotton fiber tends to adhere mounted for linear movement in a downstream direction, a fixedly positioned knife adjacent said seed cotton support and having an upstream distal end edge, an upper surface and a lower surface, said upstream distal end edge being of rounded configuration and contacting said upper surface of said seed cotton support so that seed cotton positioned on said upper surface of said seed cotton support is carried beneath said fixedly positioned knife to separate the lint from the seed which move on the upper surface of the fixedly positioned knife, an air doffing chamber downstream of said fixedly positioned knife for removing cotton fiber from the belt after it has passed beneath said fixedly positioned knife and seed removal means comprising a power driven rotary knife for removing separated seed from said fixedly positioned knife.

* * * * *